US007963718B2

(12) United States Patent
Zwier et al.

(10) Patent No.: US 7,963,718 B2
(45) Date of Patent: Jun. 21, 2011

(54) EDGE RESTRAINT FOR WATER PERMEABLE PAVEMENT SYSTEMS

(75) Inventors: Daniel G. Zwier, Holland, MI (US); Robert D. Anderson, Grandville, MI (US)

(73) Assignee: PermaLoc Corporation, Holland, MI (US)

( * ) Notice: Subject to any disclaimer, the term of this patent is extended or adjusted under 35 U.S.C. 154(b) by 47 days.

(21) Appl. No.: 12/381,711

(22) Filed: Mar. 16, 2009

(65) Prior Publication Data

US 2009/0232597 A1 Sep. 17, 2009

Related U.S. Application Data

(60) Provisional application No. 61/069,667, filed on Mar. 17, 2008.

(51) Int. Cl.
*E01C 11/22* (2006.01)

(52) U.S. Cl. ..... 404/7; 47/33; 52/102

(58) Field of Classification Search ..... 404/6, 7, 404/9; 52/102; 47/33
See application file for complete search history.

(56) References Cited

U.S. PATENT DOCUMENTS

| | | | | | |
|---|---|---|---|---|---|
| 3,520,082 | A * | 7/1970 | Smith | 47/33 |
| 3,676,952 | A * | 7/1972 | Watts | 47/33 |
| 4,125,964 | A * | 11/1978 | Waggoner | 47/33 |
| D257,064 | S * | 9/1980 | Kobee | D25/38 |
| 5,073,061 | A * | 12/1991 | Jones | 404/7 |
| 5,421,118 | A * | 6/1995 | Bauer | 47/33 |
| 5,769,562 | A * | 6/1998 | Jones | 404/7 |
| 5,930,947 | A * | 8/1999 | Eckhoff | 47/33 |
| 5,993,107 | A * | 11/1999 | Bauer | 404/43 |
| 6,030,144 | A * | 2/2000 | Cannella | 404/7 |
| 6,409,421 | B1 * | 6/2002 | Jones | 404/7 |
| 7,083,364 | B2 * | 8/2006 | Kim | 405/284 |
| 7,437,855 | B2 * | 10/2008 | Locke et al. | 52/169.14 |
| 7,774,993 | B2 * | 8/2010 | Strobl et al. | 52/102 |

* cited by examiner

*Primary Examiner* — Raymond W Addie
(74) *Attorney, Agent, or Firm* — Flynn, Thiel, Boutell & Tanis, P.C.

(57) ABSTRACT

A T-shaped edge restraint for use in water permeable pavement systems. The base (stem) of the T has a plurality of openings to facilitate the use of spikes or anchors or to facilitate curving the edge restraint to accommodate curved sections of the pavement system.

24 Claims, 13 Drawing Sheets

ACCUTRAC

V-NOTCH

SIDE VIEW

PERSPECTIVE

EDGE RESTRAINT FOR WATER PERMEABLE PAVEMENT SYSTEMS

CROSS REFERENCE TO RELATED APPLICATION

This application claims the benefit of U.S. Provisional Application Ser. No. 61/069,667, filed Mar. 17, 2008, which is incorporated herein by reference in its entirety.

FIELD OF THE INVENTION

This invention relates to an edge restraint for water permeable pavement systems and, more particularly, a T-shaped edge restraint made of a metal, plastic or similar material.

BACKGROUND OF THE INVENTION

There are known independent paver stones and interlocking paver stones that allow water to pass through the pavement system created thereby versus shedding off the pavement. The advantage of this type of system is that it reduces storm water run-off and filters the water as it passes through the system and re-enters the soil as ground water. There are unique requirements for water permeable pavement systems as compared to traditional non-permeable pavement systems in that the base for the water permeable pavement must be porous. Usually, the porous base is made up of larger aggregate that does not compact as densely as traditional base materials (a requirement to keep the base porous). Edge restraints for pavement are currently designed for use with a compacted base to which the edging restraint is anchored. When a porous "open-graded" base, i.e. crushed stone layers with no small or fine particles such as ⅜ inch stone, is used, the currently known edge restraints cannot be securely anchored to the bedding material in order to prevent the edge restraint from moving laterally away from the edge of the pavement system. The use of spikes or anchors to secure the edge restraint in place have been tried, but the spikes or anchors do not provide sufficient anchoring due to their inability to grip the porous base material. Accordingly, it is desirable to provide an edge restraint and edge restraint system specifically designed for use and to perform in concert with porous or loosely compacted bedding materials that will prevent lateral movement away from the edge of the pavement material.

According, it is an object of this invention to provide an edge restraint and an edge restraint system for use with a porous bedding material in order to facilitate the movement of surface water through the pavement system and into the bedding material and base construction and wherein the edge restraint is simultaneously prevented from movement relative to the pavement system.

SUMMARY OF THE INVENTION

This invention relates to a T-shaped edge restraint for use in water permeable pavement systems. The base (stem) of the T has a plurality of openings to facilitate the use of spikes or anchors and/or to facilitate curving the edge restraint to accommodate curved sections of the pavement system.

BRIEF DESCRIPTION OF THE DRAWINGS

Other objects and purposes of the invention will be apparent to those of ordinary skill in the art upon reading the following descriptive text with reference to the accompanying drawings, in which.

DETAILED DESCRIPTION

Figure 1:
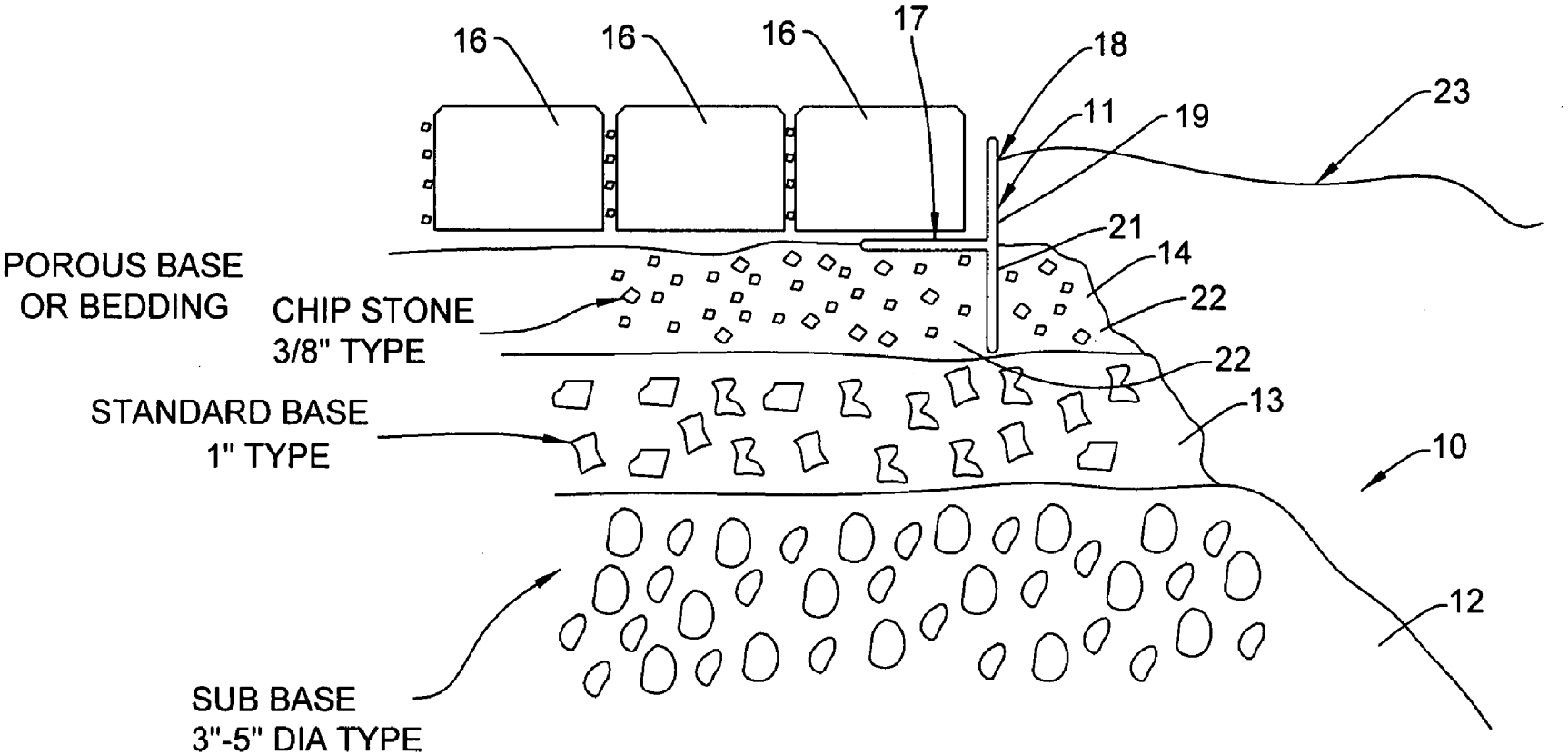
FIG. 1 is a sectional view through a typical water permeable pavement system and accompanying base material assembly therefor and employing the use of our inventive T-shaped edge restraint and wherein the stem of the T is oriented between the paver stones and the upper surface of the bedding material.

A typical base construction for use in a water permeable pavement system 10 is illustrated in FIG. 1 employing the use of our inventive T-shaped edge restraint 11. The porous base construction 10 typically includes a course material sub-base 12 composed typically of 3 to 5 inch diameter stones on top of which is placed a standard base 13 of ¾ inch to 1¼ inch stones. A porous base layer or bedding 14 composed of ⅜ inch chipped stone or comparable material is placed on top of the standard base 13. Independent paver stones or interlocked paver stones 16 are placed on top of the porous base layer or bedding 14. In most instances, the paver stones are laterally spaced from each to define a gap therebetween into which is received the aforesaid chipped stone material effectively binding the pavers in place and forming the area into which the surface water runoff will drain; further, the chipped stone functions as the bedding material onto which the paver stones are set forming the porous setting base layer 14.

For this particular construction or porous base system, we have developed a T-shaped edge restraint 11 (FIGS. 6-11) wherein the base (stem) 17 of the T is oriented horizontally between the underside of the paver stones or porous pavement system and the upper surface of the porous base layer 14. The crosswise extending part of the T 18 extends vertically with the upper half 19 of the crosswise extending part 18 forming the border for the paver stones or porous pavement system. The lower half 21 of the crosswise extending part 18 extends into the porous layer bedding and is unable to move laterally of the paver stones or porous pavement system due to the placement of porous bedding material 14 on both sides thereof as shown at 22 in FIG. 1. Earthen material 23 is typically used to fill in and oppose the immediate outside surface of the upper half 19 of the vertically extending part 18 and laterally facing sides of the base construction 10.

Figure 6:
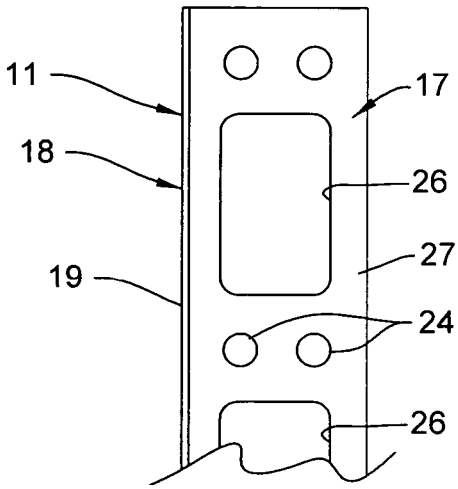
FIGS. 6-8 illustrate a first embodiment of our inventive T-shaped edge restraint.
Figure 9:
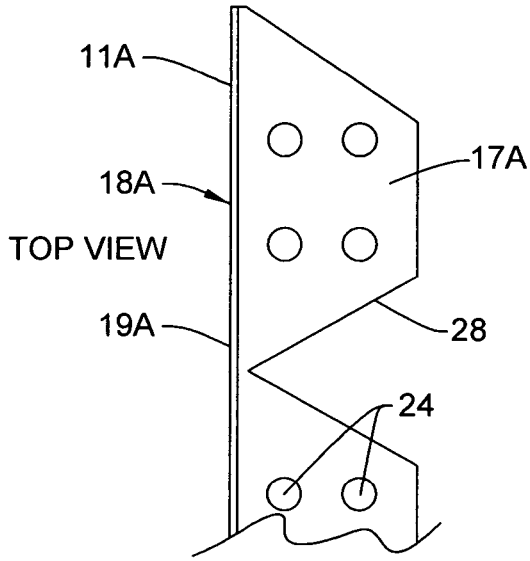
FIGS. 9-11 illustrate a second embodiment of our inventive T-shaped edge restraint.
Figure 7:
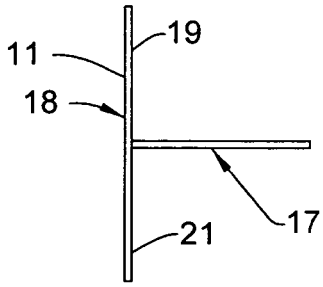
Figure 10:
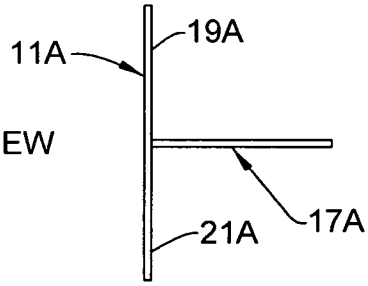
Figure 8:
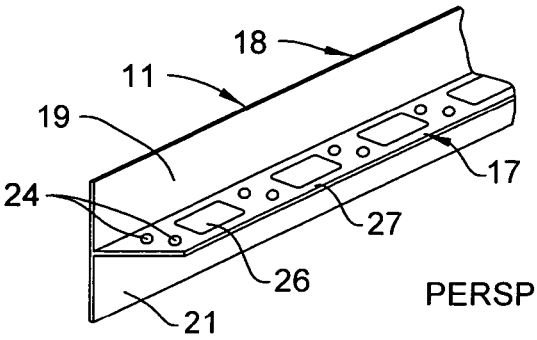
Figure 11:
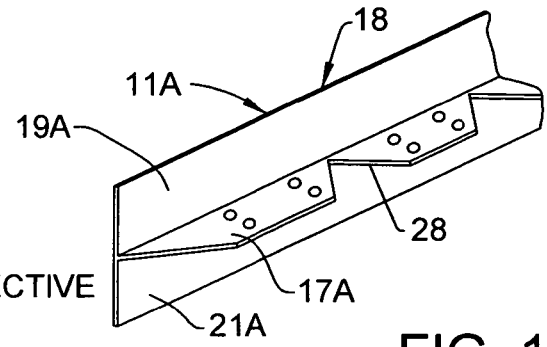

FIGS. 6 to 11 are various views of two embodiments of our T-shaped edge restraint 11 and 11A. Since these two edge restraints are identical except for the construction of the base (stem), we have utilized the same reference numbers in describing the embodiment 11A as are used in describing the embodiment 11, except for the addition of the suffix "A". The edge restraints are made of extrudable or molded material, such as aluminum, plastic or similar materials. The base (stems) 17 of each T-shaped configuration have a plurality of openings 24 therein to facilitate the use of spikes or anchors, if desired. Larger openings 26 (FIGS. 6-8) are also provided in the stem 17. These larger openings enable border portions 27 of the opening 26 to be cut out in order to facilitate a bending of the vertically extending crosswise part 18 of the T into a curved segment. In FIGS. 9-11, V-shaped cutouts 28 have been provided in the stem 17A instead of large openings as shown in FIGS. 6-8 and to facilitate bending.

Figure 2:
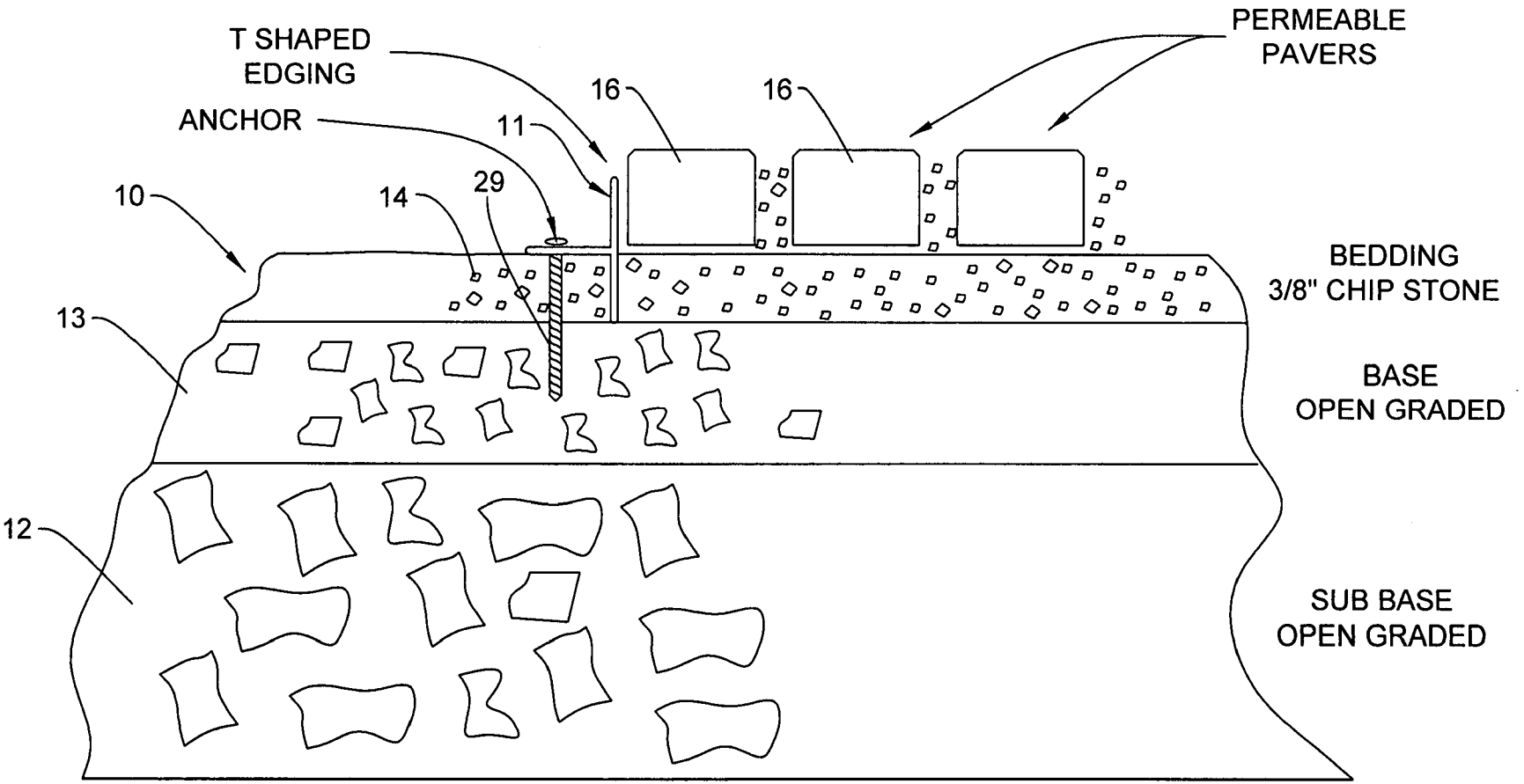
FIG. 2 is a view similar to FIG. 1; however, the T-shaped edge restraint is oriented wholly along side of the paver stones.

FIG. 2 illustrates a further cross section of a typical base construction 10 identical to FIG. 1. In this particular embodiment, the T-shaped edge restraint 11 is oriented along side of the paver stones 16 and anchored in place by a spike 29 that is long enough to extend through the bedding material 14 into the standard base material 13. The combination of the spike 29 and the lower part 21 of the crosswise extending part of the T being buried in the bedding material 14 serves to hold the edge restraint in place.

Figure 3:
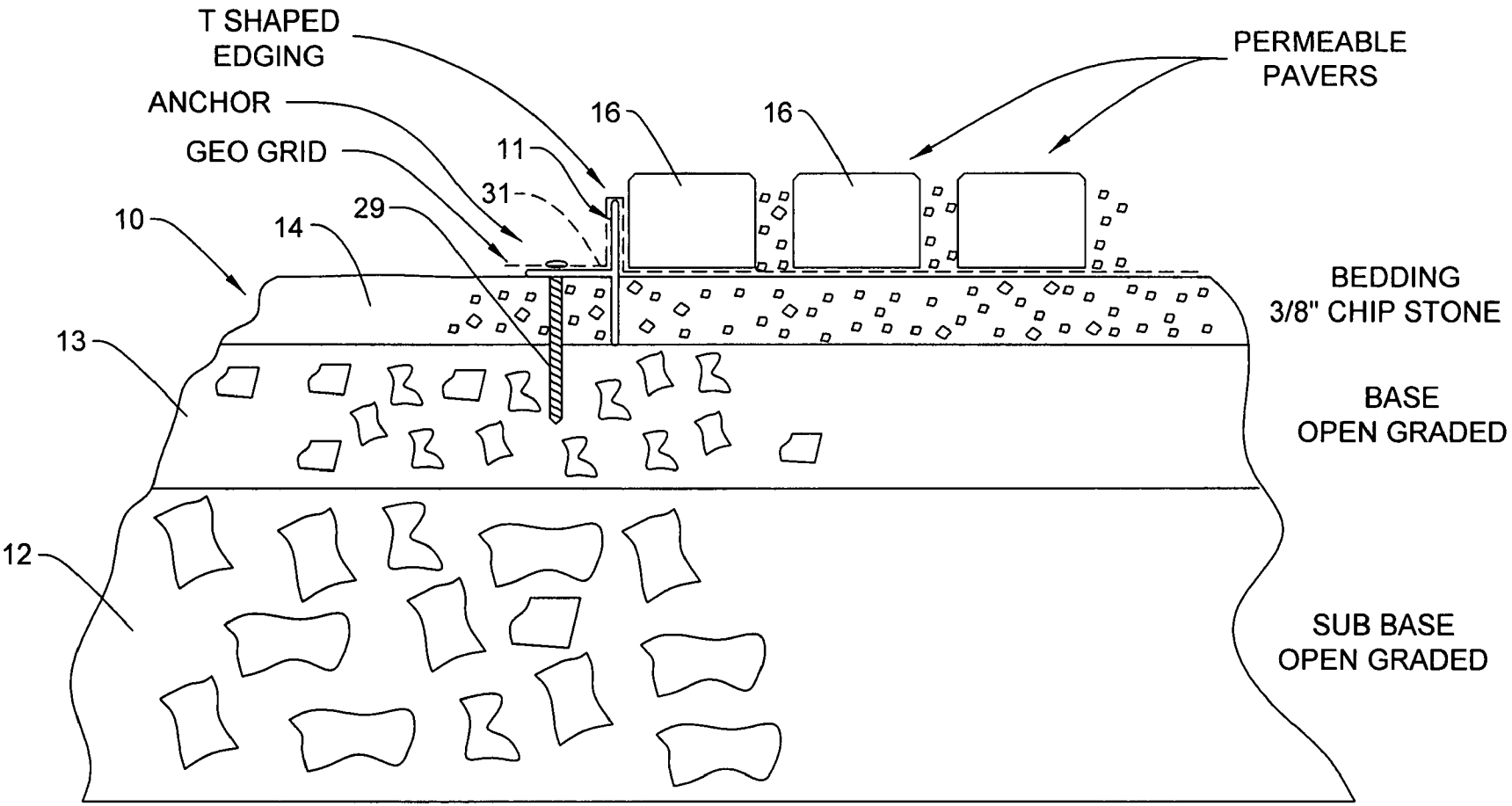
FIG. 3 is a view similar to FIG. 2; however, a geo grid or similar material is oriented beneath the paver stones and on top of the bedding material and extends over the upper part of the crosswise extending vertical leg of the T.

FIG. 3 illustrates a further cross section of a typical base construction 10 identical to FIGS. 1 and 2. In this embodiment, a porous geo grid or similar material 31 is placed between the paver stones or porous pavement system 16 and the porous layer bedding material 14. In addition, the geo grid or similar material 31 extends over the top edge of the section 19 of the crosswise extending part 18 of the T and lays flat against the horizontal base (stem) part 17 and is held thereto by the spike or anchor 29. The geo grid or similar material 31 serves to prevent the T-shaped edge restraint from moving laterally with respect to the paver stones 16 and the parallel edge restraint to which the geo grid or similar material is also fastened in the same fashion.

Figure 4:
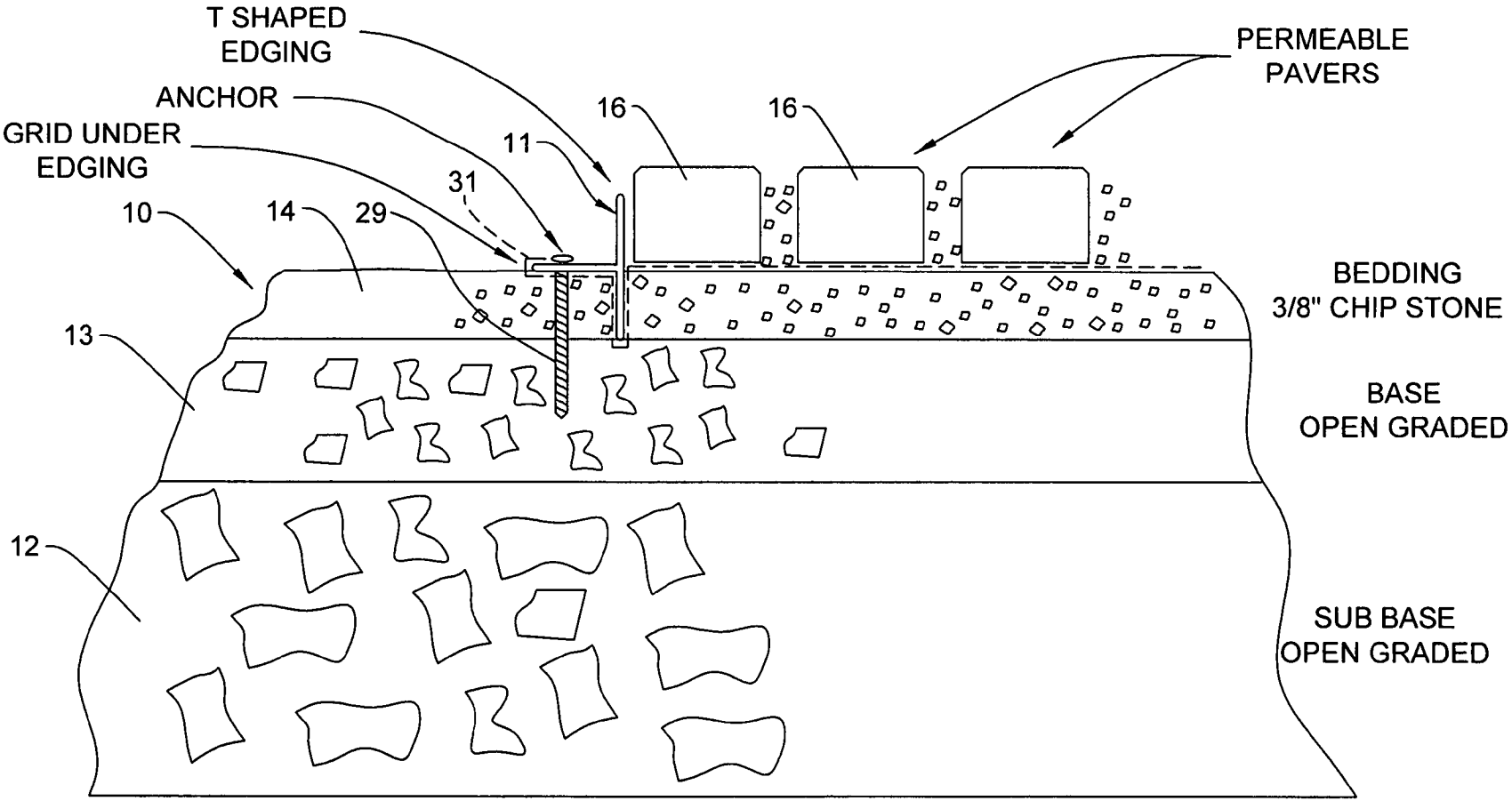
FIG. 4 is a view similar to FIG. 2; however, a geo grid or similar material is oriented beneath the paver stones and on top of, or between, the bedding material and the stone coarse beneath it and extends under the lower part of the crosswise extending vertical leg of the T.

FIG. 4 illustrates a further cross section of a typical base construction 10 identical to FIGS. 1 and 2. In this embodiment, a geo grid or similar material 31 is placed between the paver stones or porous pavement system 16 and the porous layer of bedding material 14. In addition, the geo grid or similar material 31 extends under the lower edge of the section 21 of the crosswise extending part 18 of the T, along the underside of the base (stem) 17 and around the outer lateral edge of the base (stem) to overlay the upper surface of the base (stem). The geo grid or similar material 31 is secured to the base (stem) 17 of the edge restraint 11.

Figure 5:
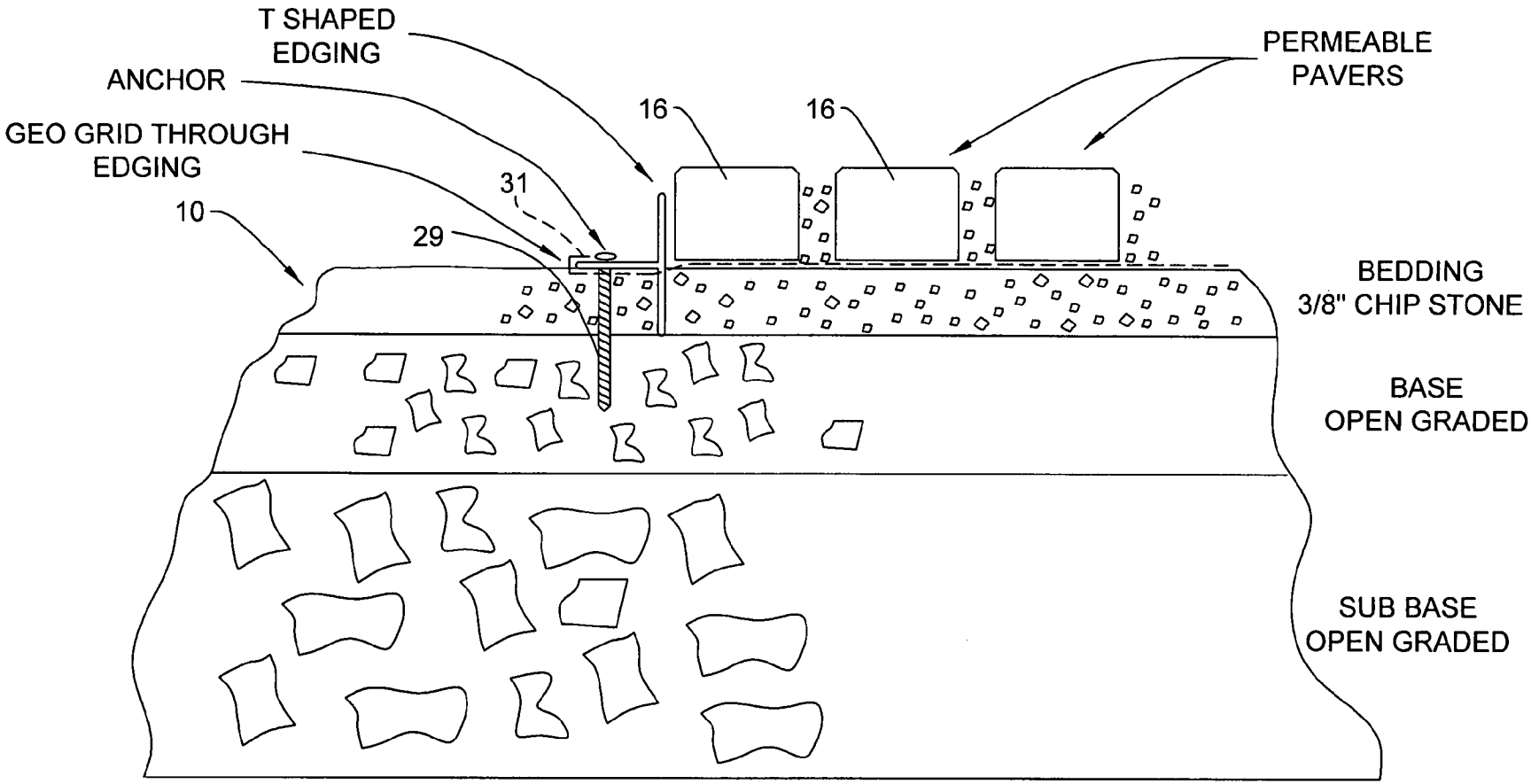
FIG. 5 is a view similar to FIG. 2; however a geo grid or similar material is oriented beneath the paver stones and on top of the bedding material and the crosswise extending part of the T extends through openings in the geo grid or similar material.
Figure 16:
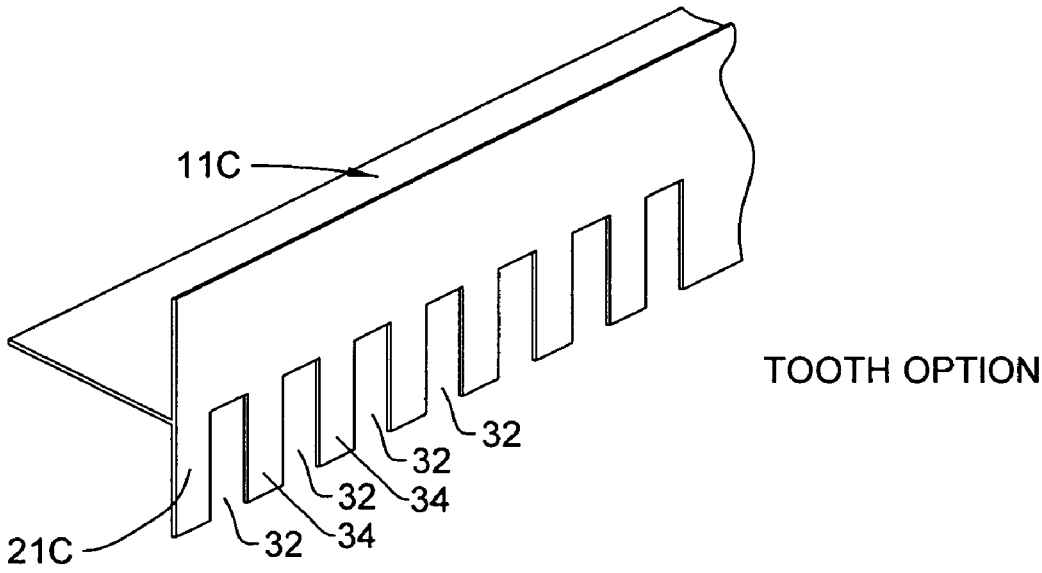
FIG. 16 illustrates a fifth embodiment of our inventive T-shaped edge restraint.
Figure 17:
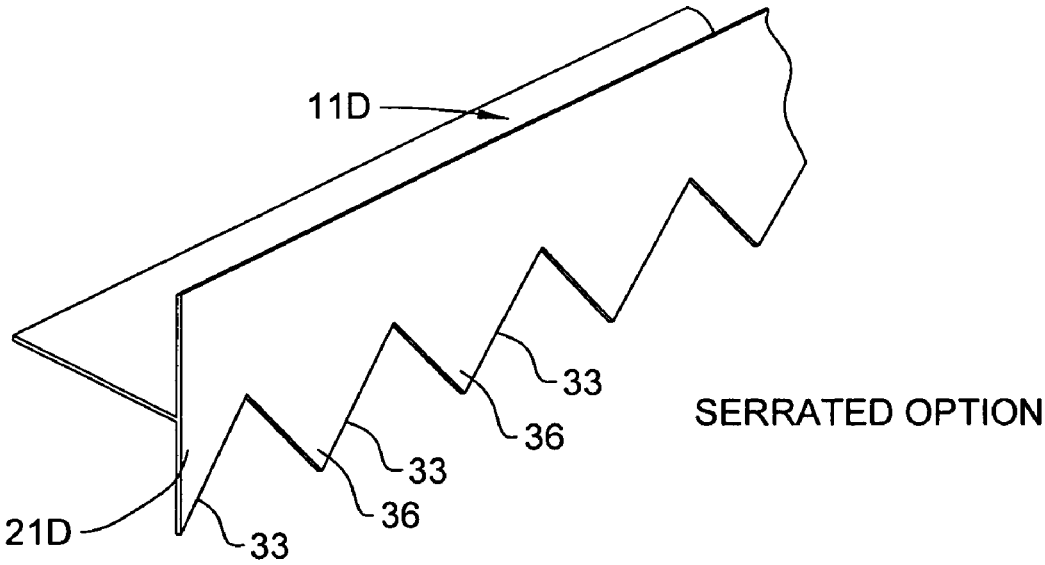
FIG. 17 illustrates a sixth embodiment of our inventive T-shaped edge restraint.

FIG. 5 illustrates a further cross section of a typical base construction 10 identical to FIGS. 1 and 2. In this embodiment, a geo grid or similar material 31 is placed between the paver stones or porous pavement system 16 and the porous layer of bedding material 14. In addition, the geo grid or similar material 31 contains openings periodically along a line coextensive with the crosswise extending part of the crosswise extending part of the T. The T-shaped restraint is further modified as illustrated in FIGS. 16 and 17 to form edge restraints 11C and 11D. That is, the lower sections 21C and 21D of the crosswise extending parts 18 of each T is configured to have a plurality of longitudinally spaced cutouts 32 (FIG. 16) and 33 (FIG. 17) defining projections 34 and 36, respectively, that are each configured to extend through the aforementioned openings in the geo grid or similar material and into the bedding material 14. The plurality of longitudinally spaced cutouts 32 (FIG. 16) and 33 (FIG. 17) defining projections 34 and 36 respectively are also designed to be capable of biting or binding into uncut or unaltered geo grid or similar material when it is installed into the setting bed material 14.

Figure 12:
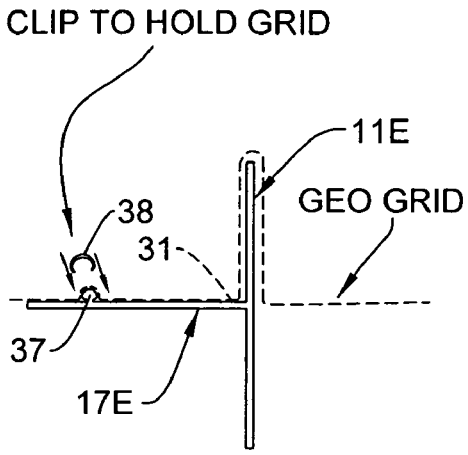
FIGS. 12-13 illustrate a third embodiment of our inventive T-shaped edge restraint.
Figure 13:
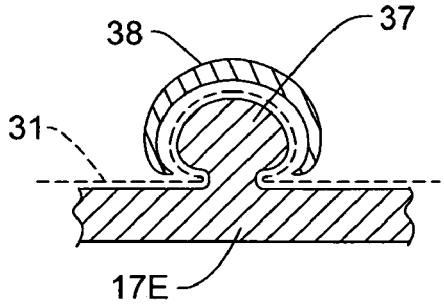
Figure 14:
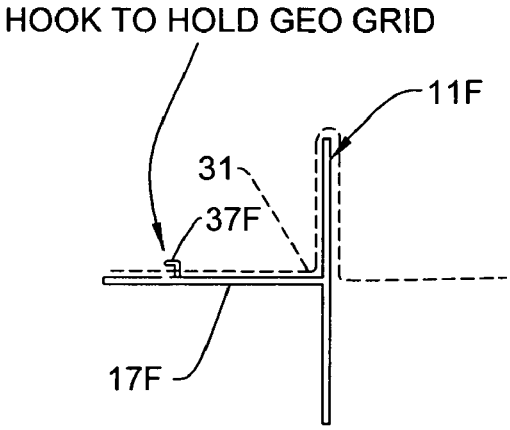
FIGS. 14-15 illustrate a fourth embodiment of our inventive T-shaped edge restraint.
Figure 15:
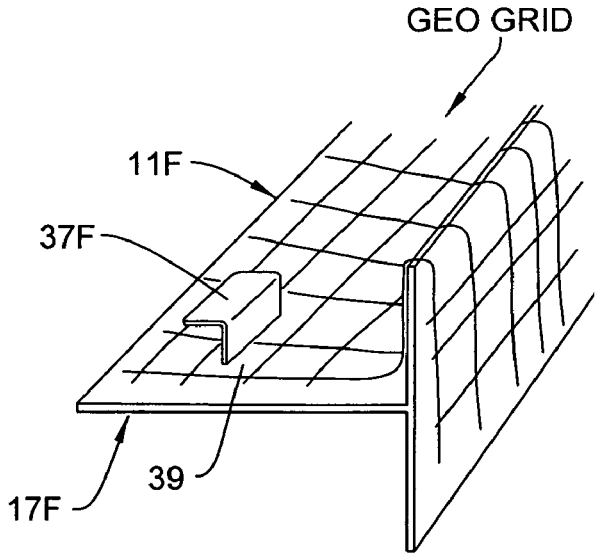

FIGS. 12 and 13 illustrate a modification of the construction illustrated in FIG. 3. That is, the base (stem) 17E of a further modified version of the T-shaped edge restraint 11E has an upstanding and longitudinally extending bead 37 on the upper facing side thereof. The geo grid or similar material 31 is configured to overlay the upper face of the base (stem) 17E and the bead 37 as shown in FIGS. 12 and 13. An elongate C-shaped clip 38 is configured to receive therein the bead 37 to clamp the geo grid or similar material 31 in place against the inside walls of the C-shaped clip 38 and the exterior surface of the bead 37. In FIGS. 14 and 15, there is illustrated a further modified T-shaped edge restraint 11F wherein the bead 37F is an inverted L-shape. The inverted L is configured to be received in an opening 39 (FIG. 15) in the geo grid or similar material 31 and not require the provision of a clip comparable to the clip 38. In the alternative, the geo grid material 31 can be clamped between a base (stem) 17G of a further modified restraint 11G and an elongate plate 39 extending coextensively with the restraint 11G. Plural self-tapping screws 41 are utilized for drawing the plate 39 and the base 17G together to clamp the geo grid material therebetween. It is to be recognized that the plate 39 can be oriented above the base 17G or below it (as shown in FIG. 18) in order to achieve a stable connection of the geo grid material to the edge restraint 11G so as to provide a stable connection of the restraint relative to the ground or bed upon which the restraint and geo grid material are placed.

Alternate Capture Plate Construction

Figure 18:
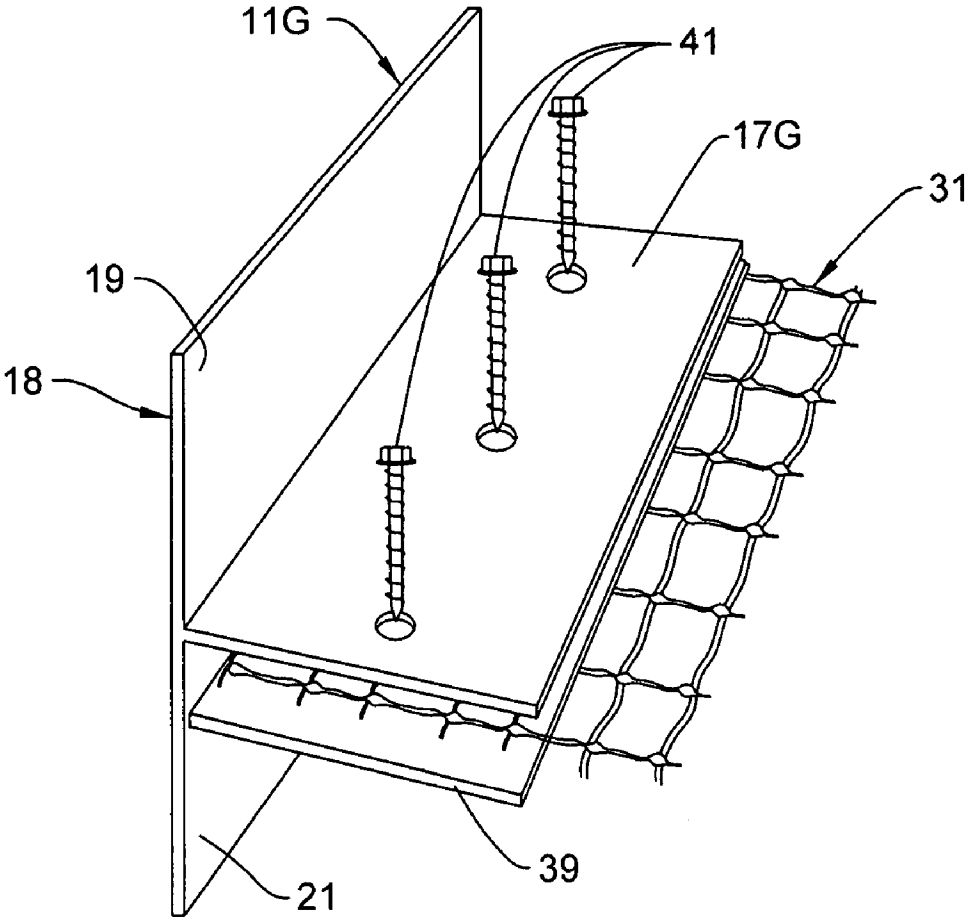
FIG. 18 illustrates an alternative structure for securing a porous material, such as a geo grid material, to our inventive edge restraint.

Several modifications of the capture plate 39 shown in FIG. 18 are illustrated in FIGS. 19-26.

Figure 19:
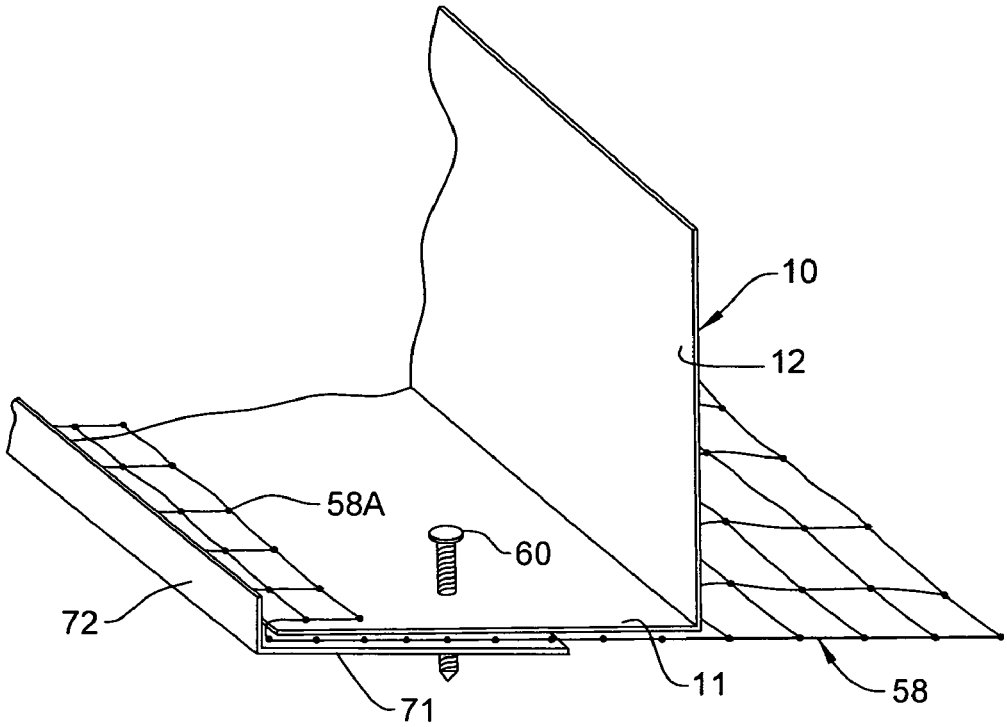
FIG. 19 is an isometric view of a modified capture plate operatively connected to the edging strip and the porous or geo grid layer.
Figure 21:
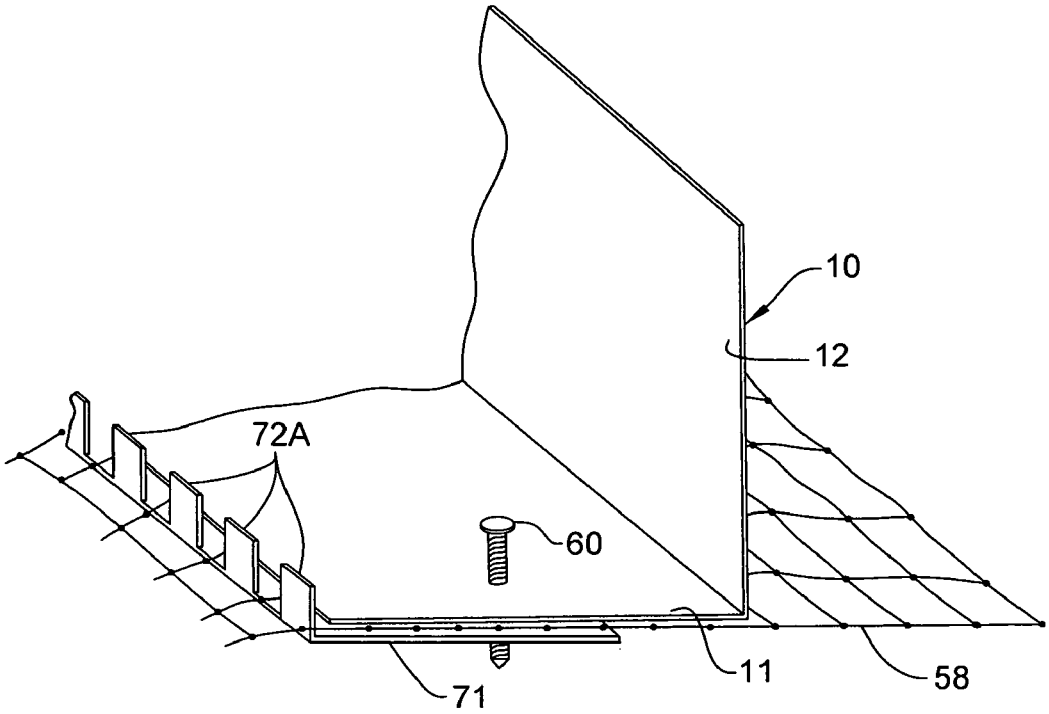
FIG. 21 is an isometric view of a further modified capture plate.

In FIG. 19, the modified capture plate 71 has an upstanding lip 72 along one edge. The porous layer or geo grid layer 58 is placed between the upper surface of the capture plate 71 and the underside of the base leg 11 of the edging strip and an edge 58A of the porous layer of geo grid layer is wrapped over the edge of the base leg 11 and overlays the upwardly facing surface of the base leg as shown in FIG. 19. Plural self-tapping screws 60 are utilized to secure the base leg 11 to the capture plate 71. The upstanding lip 72 serves to prevent relative movement between the edging strip 10 and the porous layer or geo grid layer. FIG. 21 is similar to FIG. 19 except that the lip 72 is separated into multiple upstanding lips 72A configured to enter the open spaces provided in the porous layer or geo grid layer. In the FIG. 21 embodiment, the porous layer or geo grid layer does not overlay the upper surface of the base leg 11 of the edging strip.

Figure 20:
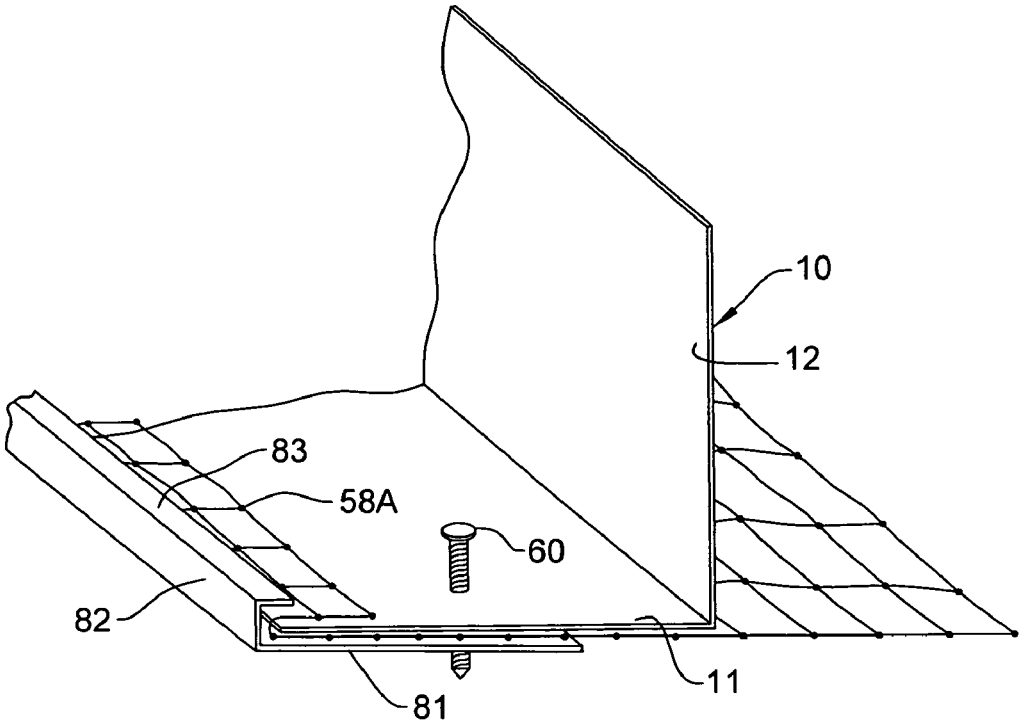
FIG. 20 is an isometric view of a further modified capture plate.
Figure 22:
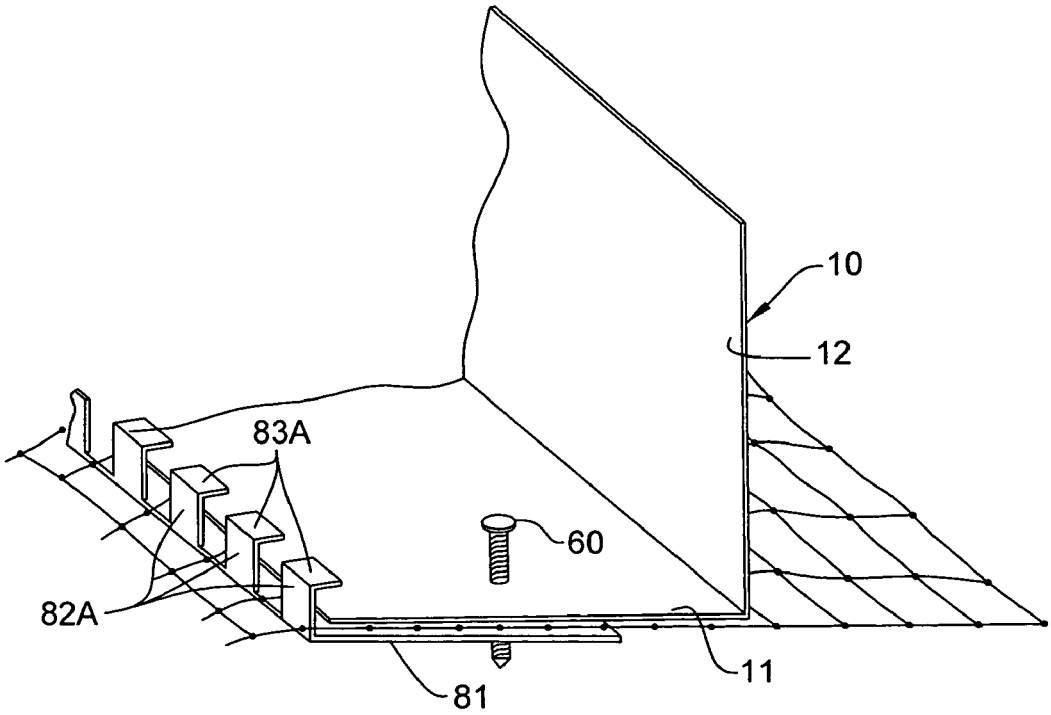
FIG. 22 is an isometric view of a still further modified capture plate.
Figure 23:
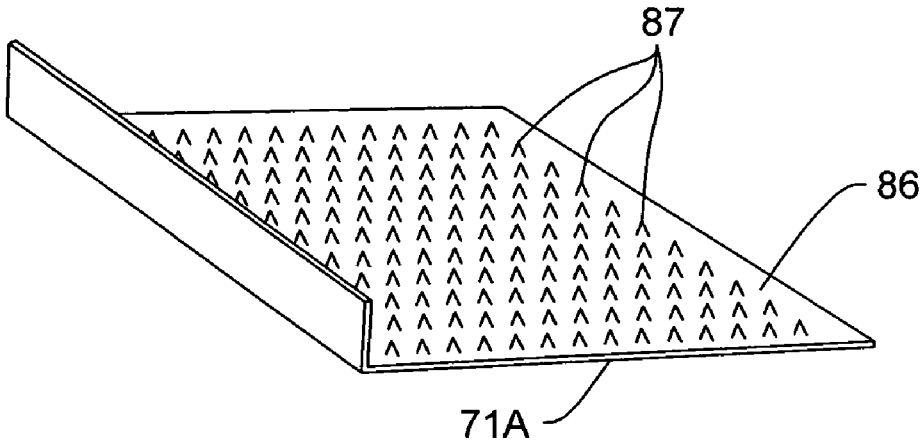
FIGS. 23-26 are each an isometric view of the respective modified capture plates of FIGS. 19-22 but with plural upstanding barbs on one face of the respective capture plate.
Figure 24:
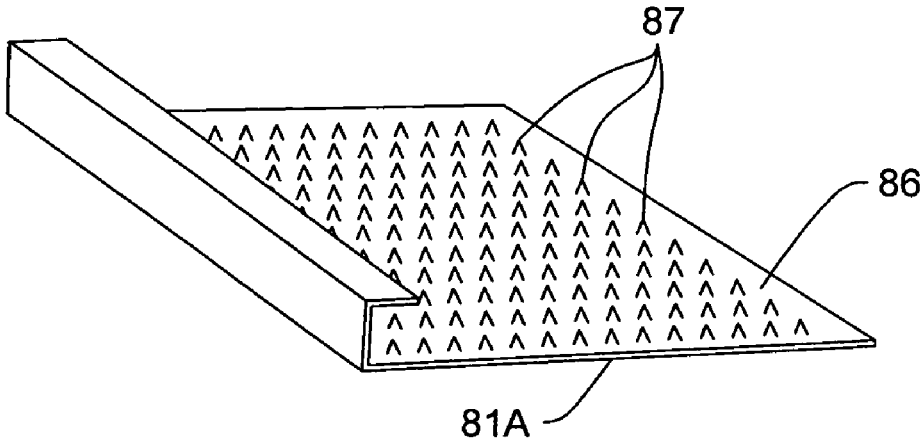
Figure 25:
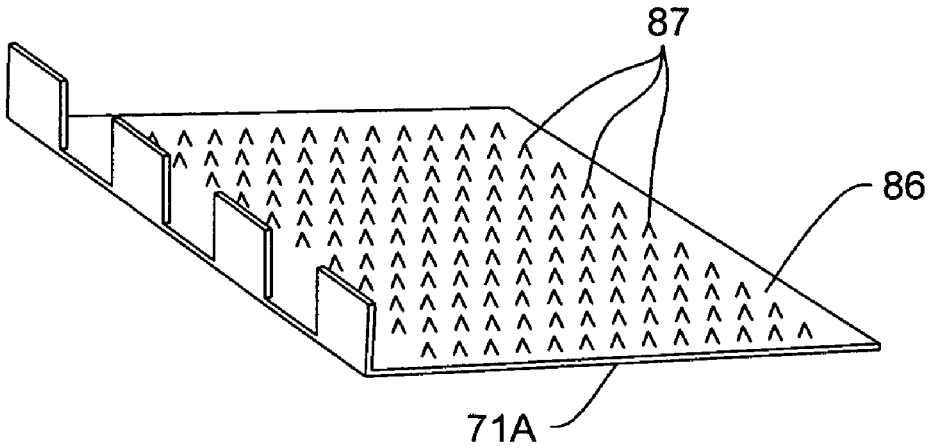
Figure 26:
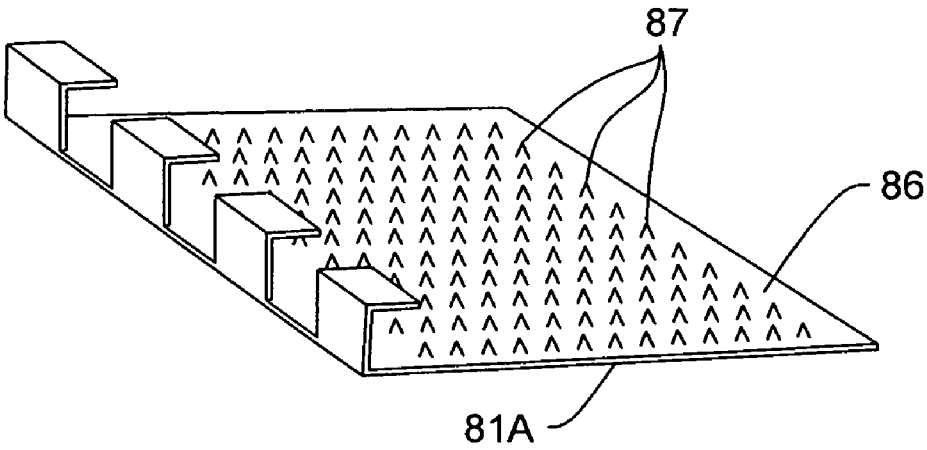

In FIG. 20, the modified capture plate 81 has an upstanding lip 82 along one edge. The upper edge of the lip 82 has a flange 83 extending generally parallel to a plane containing the capture plate 81 and toward the vertically upstanding leg 12 of the edging strip 10. The porous layer or geo grid layer 58 is placed between the upper surface of the capture plate 81 and the understand of the base leg 11 of the edging strip and an edge 58A of the porous layer of geo grid layer is wrapped over the edge of the base leg 11 and overlays the upwardly facing surface of the base leg as shown in FIG. 20. Plural self-tapping screws 60 are utilized to secure the base leg 11 to the capture plate 81. The upstanding lip 82 and flange 83 serve to prevent relative movement between the edging strip 10 and the porous layer or geo grid layer 58. FIG. 22 is similar to FIG. 20 except that the lip 82 and flange 83 configuration depicted in FIG. 20 is separated into multiple upstanding lips 82A and flanges 83A in FIG. 22, each configured to enter the open spaces provided in the porous layer or geo grid layer. In the FIG. 22 embodiment, the porous layer or geo grid layer 58 does not overlay the upper surface of the base leg 11 of the edging strip 10.

FIGS. 23-26 each illustrate a modified capture plate that is similar to the capture plates 71 and 81 illustrated in FIGS. 19-22. The upper facing surface 86 of each of the modified capture plates 71A and 81A have plural upstanding barbs 87 or the like that are configured to intermesh with the porous layer or geo grid layer 58 to further prevent relative movement between the edging strip 10 and the porous layer or geo grid layer 58.

It is to be understood that the capture plates can be positioned above the upper surface of the base leg 11 of the edging strip 10 and oriented so that the respective lips project downwardly through the open space in the porous or geo grid layer 58. Plural self-tapping screws would also be utilized to secure the capture plates to the respective base leg 11 of the edging strip 10.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An edge restraint assembly for a water permeable pavement system having a loose water permeable base onto which has laid a porous material layer, comprising:

a unitary member comprised of a first flat plate-like member of finite length and width configured to lie flat on an upper surface of the base and a second flat plate-like member also of a finite length extending coextensively with said length of said first plate-like member and a width oriented in a plane perpendicular to a plane of said first flat plate-like member and being connected intermediate the lateral edges thereof to one end of said first plate-like member to form a T-shape, a first portion of said second plate-like member that extends in a first direction from said first plate-like member being configured to restrain horizontal movement of the pavement system oriented on said upwardly facing surface of the base and on the porous material layer, a second portion of said second plate-like member being configured to extend in a second direction opposite said first direction and into the base to anchor said unitary member thereto; and wherein said edge restraint assembly includes a further plate-like member oriented initially either vertically above or vertically below said first plate-like member and plural fastening members for fastening said first plate-like member to said further plate-like member to draw said first plate-like member and said further plate-like member toward each other to clamp the porous material layer therebetween to thereby fixedly orient said edging strip relative to the porous material layer and the landscape surface on which said edging strip has been placed.

2. The edge restraint assembly according to claim 1, wherein said second plate-like member is connected at a mid-width location thereon to said one end of said first plate-like member.

3. The edge restraint assembly according to claim 1, wherein one lengthwise extending lateral edge of said second portion of said second plate-like member has plural projections configured to enhance penetration of said second portion into the base.

4. The edge restraint assembly according to claim 1, wherein said first plate-like member has at least one hole configured to receive an elongate stake to further anchor said unitary member to the base.

5. The edge restraint assembly according to claim 1, wherein said first plate-like member has plural holes therethrough arranged in an alternating pattern of at least one hole being configured to receive an elongate stake and at least one hole larger than said at least one hole.

6. The edge restraint assembly according to claim 1, wherein said first plate-like member has plural holes therethrough arranged in an alternating pattern of a least one hole being configured to receive an elongate stake and a notch oriented in a lengthwise extending lateral edge that is remote from said second plate-like member.

7. The edge restraint assembly according to claim 1, wherein said first plate-like member has on an upper surface thereof an upwardly extending protrusion configured to become engaged with a porous material layer oriented intermediate an upper surface of the base and an underside of the pavement system.

8. The edge restraint assembly according to claim 7, wherein said protrusion is composed of a raised bead integral with said first plate-like member and is configured to couple to a clip, said bead and said clip being jointly configured to clamp the porous material layer therebetween.

9. The edge restraint assembly according to claim 7, wherein said protrusion is composed of a raised inverted L-shaped member configured to enter an open space provided in the porous material layer.

10. The edge restraint assembly according to claim 1, wherein said first plate-like has member on an upper surface thereof an upwardly extending protrusion configured to become engaged with the porous material layer oriented intermediate an upper surface of the base and an underside of the pavement system.

11. The edge restraint assembly according to claim 10, wherein said protrusion is composed of a raised bead integral with said first plate-like member and is configured to couple to a clip, said bead and said clip being jointly configured to clamp the porous material layer therebetween.

12. The edge restraint assembly according to claim 10, wherein said protrusion is composed of a raised inverted L-shaped member configured to enter an open space provided in the porous material layer.

13. The edge restraint assembly according to claim 1, wherein said second plate-like member is connected at a mid-width location thereon to said one end of said first plate-like member.

14. The edge restraint assembly according to claim 1, wherein one lengthwise extending lateral edge of said second portion of said second plate-like member has plural projections configured to enhance penetration of said second portion into the base.

15. The edge restraint assembly according to claim 14, wherein said porous material layer includes plural openings that extend parallel to the lengthwise extending direction of said assembly and into which is received therethrough said projections oriented on said one lengthwise extending lateral edge.

16. The edge restraint assembly according to claim 1, wherein said first plate-like member has at least one hole configured to receive an elongate stake to further anchor said unitary member to the loose water permeable base and to effect an attachment of the porous material layer to said unitary member.

17. The edge restraint assembly according to claim 1, wherein said first plate-like member has plural holes therethrough arranged in an alternating pattern of at least one hole being configured to receive an elongate stake and at least one hole larger than said at least one hole.

18. The edge restraint assembly according to claim 1, wherein said first plate-like member has plural holes therethrough arranged in an alternating pattern of at least one hole being configured to receive an elongate stake and a notch oriented in a lengthwise extending lateral edge that is remote from said second plate-like member.

19. The landscape edging system according to claim 1, wherein said further plate-like member has an upstanding lip along one edge thereof.

20. The landscape edging system according to claim 19, wherein said upstanding lip has a flange extending parallel to a plane of the further plate-like member.

21. The landscape edging system according to claim 19, wherein said upstanding lip extends coextensively with a longitudinal extent of said further plate-like member.

22. The landscape edging system according to claim 19, wherein said upstanding lip consists of plural and separate upstanding lips longitudinally aligned along said one edge of said edging strip.

23. The landscape edging system according to claim 1, wherein at least one of a first face on said further plate-like member and a second face on said first plate-like member opposing said first face is configured to provide a non-planar surface to enhance the gripping ability thereof with the porous material layer when the porous material layer is clamped between said first and second faces.

24. The landscape edging system according to claim 23, wherein one face of said further plate-like member has plural upstanding barbs over a major surface area thereof.

* * * * *

UNITED STATES PATENT AND TRADEMARK OFFICE

CERTIFICATE OF CORRECTION

PATENT NO. : 7,963,718 B2
APPLICATION NO. : 12/381711
DATED : June 21, 2011
INVENTOR(S) : Daniel G. Zwier et al.

It is certified that error appears in the above-identified patent and that said Letters Patent is hereby corrected as shown below:

Column 6, line 54, please replace "plate-like has member" with

--plate-like member has--.

Signed and Sealed this
Fifth Day of June, 2012

David J. Kappos

David J. Kappos
*Director of the United States Patent and Trademark Office*